United States Patent [19]

Oka et al.

[11] 4,053,328

[45] Oct. 11, 1977

[54] ZINC PHOSPHATE COATING PROCESS

[75] Inventors: Shoji Oka, Nara; Tamotsu Sobata, Osaka; Teturo Kishimoto, Izumiotsu; Kazuo Nobe, Kyoto, all of Japan

[73] Assignee: Nippon Paint Co., Ltd., Japan

[21] Appl. No.: 607,821

[22] Filed: Aug. 25, 1975

[30] Foreign Application Priority Data

Aug. 30, 1974 Japan ..... 49-100077

[51] Int. Cl.[2] ..... C23F 7/08

[52] U.S. Cl. ..... 148/6.15 Z; 118/326; 118/314; 118/602

[58] Field of Search ..... 148/6.15 Z, 6.15 R; 118/326, 314, 602

[56] References Cited

U.S. PATENT DOCUMENTS

| | | | |
|---|---|---|---|
| 2,743,204 | 4/1956 | Russell | 148/6.15 Z |
| 3,294,593 | 12/1966 | Wyszomirski | 148/6.15 Z |
| 3,597,283 | 8/1971 | Snee | 148/6.15 Z |
| 3,619,300 | 11/1971 | Heller et al. | 148/6.15 Z |
| 3,676,224 | 7/1972 | Snee | 148/6.15 Z |
| 3,906,895 | 9/1975 | Morino et al. | 148/6.14 R X |

*Primary Examiner*—Ralph S. Kendall

*Attorney, Agent, or Firm*—Wenderoth, Lind & Ponack

[57] ABSTRACT

Zinc phosphate coating solution contains phosphate ions in an amount of at least 0.5 percent by weight and in the phosphate ion to nitrate ion molar weight ratio of from 1 : 0.7 to 1 : 1.3. This solution also contains zinc ions in an amount, preferably, of at least 0.03 percent by weight and in a ratio of zinc ion to phosphate ion of less than 0.116 to 1. Nickel ions may be added in an amount of at least 0.01 percent by weight and in the nickel ion to zinc ion ratio of less than 1.89 to 1. The pH value of this solution ranges from about pH 3.3 to pH 3.8, whereby the consumption of nitrites employed as accelerators is reduced and sludges are formed in less amounts as in the form easily removable from an apparatus where the phosphating is effected. The zinc phosphate coating solution is preferably employed for an apparatus in which little or no solution is discharged out of the phosphating system.

14 Claims, 1 Drawing Figure

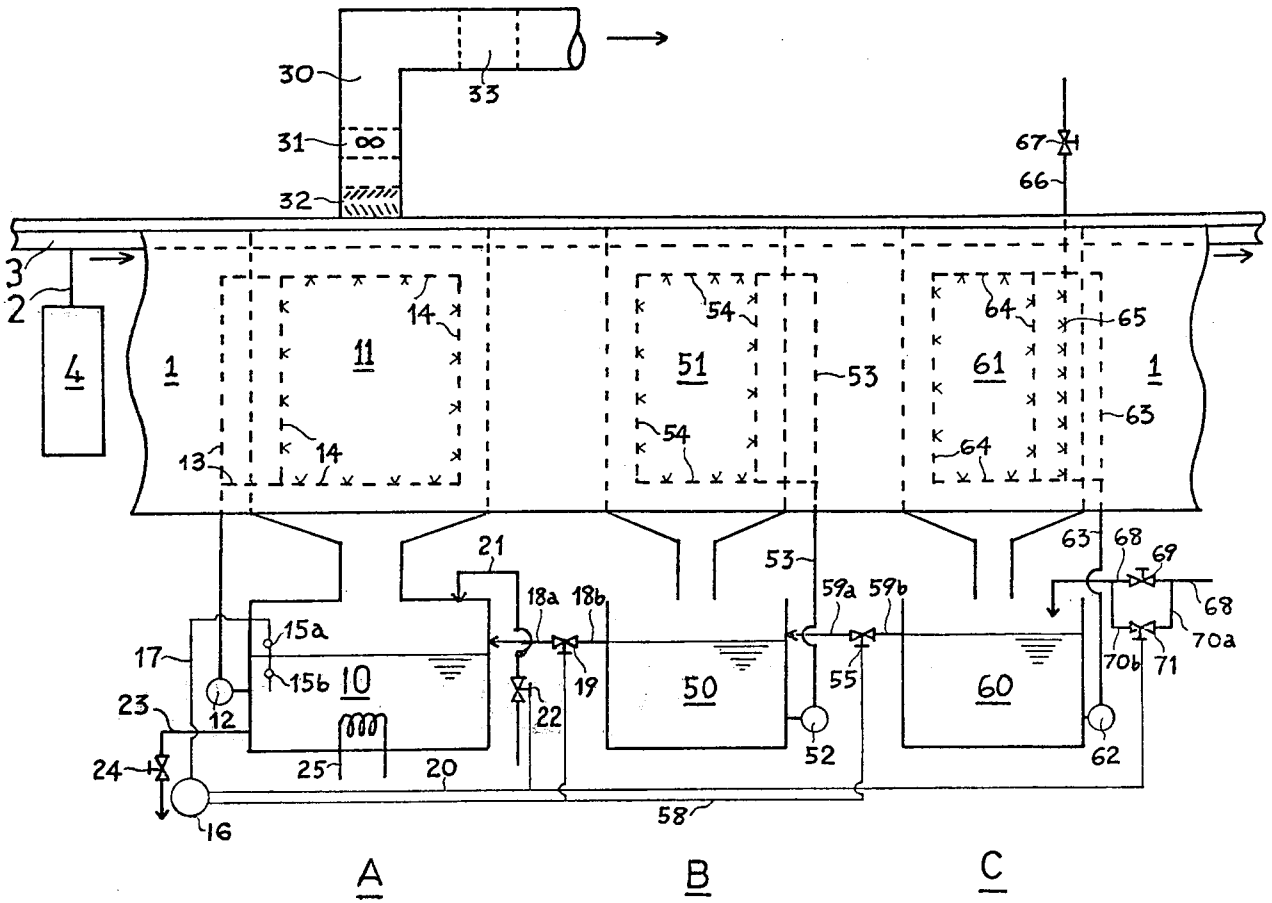
A
B
C
1
2
3
4
10
11
12
13
14
15a
15b
16
17
18a
18b
19
20
21
22
23
24
25
30
31
32
33
50
51
52
53
54
55
58
59a
59b
60
61
62
63
64
65
66
67
68
69
70a
70b
71

ZINC PHOSPHATE COATING PROCESS

The present invention relates to a zinc phosphate coating solution and use thereof for zinc phosphate coating processes. More particularly, it relates to such a solution which is capable of being maintained at a relatively high pH value in forming zinc phosphate coatings on metal surfaces. Such zinc phosphate coatings possess sufficient coating properties as a paint base. Furthermore, said coating solution can serve as reducing the consumption of nitrites which are employed as accelerators for phosphating processes. The employment of said coating solution can also function to transform sludges which are formed as by-products in phosphate coating processes into a form easily removable and less sticky and at the same time reduce amounts of such sludges formed.

Conventional zinc phosphate coating solutions generally contain zinc ions, alkali metal ions such as sodium, and one or more of metal ions such as nickel, calcium, manganese, copper, iron ions and the like as cations, and phosphate ions and one or more of nitrate, nitrite, chlorate ions and the like as anions. Amounts of those ions may be varied depending mainly upon the desired characteristics of phosphate coatings and the conditions for metal surface treatment and of equipment therefor and/or the conditions for zinc phosphate coating processes. Attempts have heretofore been made to improve coating efficiency and thereby form uniform and fine zinc phosphate coatings on a metal object. For example, improvements were made in controlling the concentration of zinc ion with respect to the phosphate ions present in zinc phosphate coating solutions as disclosed in a Japanese patent application as laid open to public inspection as No. 15,725/1973; in adding calcium ions to conventional zinc phosphate coating solutions as disclosed in Japanese Patent Publication No. 26,073/1963; and in adding polyhydric alcohols or their phosphate esters as disclosed in Japanese Patent Publications No. 26,455/1967 and No. 4,324/1965.

Where those conventional zinc phosphate coating solutions as improved hereinabove are applied to continuous operation of forming phosphate coatings on continuous steel surfaces or the metal object, they become stabilized at pH values ranging from pH 2.4 to pH 3.1. Within the scope of said pH range, however, the formation of sludges in comparably large amounts may be unavoidable. The formation of sludges may be detrimental to the continuous operation of phosphate coating process because they tend to adhere to equipment such as spraying pipes, nozzles, tanks and heaters in which the phosphate coating is effected, thereby impairing the phosphating process. Such sludges should accordingly be removed periodically from the equipment by cleaning or washing with acids. Removal of such sludges requires a great deal of laborers' work and cost, and they are usually dumped under the ground. However, the sludges should be treated, prior to the dumping, in order to remove heavy metals such as zinc present therein which otherwise may be a cause of contamination and pollution. The nitrites employed generally as the accelerators may also be decomposed and consumed in the phosphating, and they are decomposed by themselves or "self-decomposed" within said pH range. This tendency may be increased with a decrease in pH values in the phosphate coating solution, thereby forming a relatively large amount of nitrogen oxides which may also be pollutants. That the amount of the nitrites self-decomposed is increased raises the cost of phosphating coatings, and the tendency to form nitrogen oxides with the lowering of a pH value of the coating solution may be disadvantageous from the standpoint of both environmental prevention and harzards to the health of operators. It is thus desired that zinc phosphate coating solutions can maintain the pH value at a higher level, form coatings with good coating properties and, at the same time, reduce the formation of sludges in a considerably smaller amount. It is further advantageous that sludges tend to be in a less sticky and readily removable form. In a system where the accelerating agents such as nitrites which are prone to be self-decomposed in an acidic solution are employed, it is desired to have such accelerators dissolved in the phosphate coating solution as little as possible.

Where conventional zinc phosphate coating solutions containing nitrites as accelerators are applied to an apparatus in which little or no coating solution is discharged from the treating system as that disclosed in U.S. patent application Ser. No. 318,612 to Morino et al. now Pat. No. 3,906,895, alkali metal ions such as sodium or potassium ions and nitrate ions may be accumulated in the coating bath, thereby impairing zinc phosphate coating processes and resulting in the formation of rusts on the surfaces of the metal object. In order to avoid these disadvantages involved in the conventional solutions, it is necessary to replace such solutions by fresh coating solutions more often than where there is used conventional apparatus designed to drain off the coating solution out of the treating system.

It is therefore an object of the present invention to provide a zinc phosphate coating solution which can obviate the disadvantages involved in conventional zinc phosphate coating solutions. Another object of the present invention is to provide a zinc phosphate coating solution particularly suitable for an apparatus which is designed so as to drain off little or no coating solution from the treating system. Other objects, features and advantages of the present invention will be more fully understood from the following detailed description and the appended claims.

It has been found that a zinc phosphate coating solution containing phosphate and zinc ions in particular amounts and having particular pH ranges and ratios of phosphate ion to nitrate ion can achieve the objects of the present invention. It is necessary that the phosphate ions are present in an amount of at least about 0.5 percent by weight, preferably from about 0.5 to about 10 percent by weight, with respect to the coating solution and the molar weight ratio thereof to nitrate ion ranges from about 1:0.7 to 1:1.3. The zinc ions are present preferably in an amount of at least about 0.03 percent by weight based on the solution, preferably from about 0.03 to 0.80 percent by weight, and in the molar weight ratio thereof to phosphate ion of from about 0.116:1 to 0.005:1. Said zinc phosphate coating solutions also contan nitrate, nitrite and alkali metal ions, and/or ammonium ions. The presence of nickel ions is preferred. In this case, it is desired that the solution contain nickel ions in an amount of at least about 0.01 percent by weight, preferably from about 0.01 to 1.35 percent by weight, with respect to the solution and the molar weight ratio of nickel ion to zinc ion may vary from about 1.89:1 to 0.014:1.

The ions comprising and needed for the zinc phosphate coating solution of the present invention may be supplied from various sources. The sources may usually include, for example, phosphoric acids, nitric acid, sodium nitrite, potassium nitrite, ammonium nitrite, zinc flower, zinc carbonate, zinc nitrate, sodium hydroxide, potassium hydroxide, ammonium hydroxide, sodium carbonate, ammonium carbonate, nickel carbonate and nickel nitrate.

It is also necessary that the zinc phosphate coating solution of the present invention has a pH value ranging from about pH 3.3 to pH 3.8. The pH values of the coating solution can be maintained within said desired scope even in continuous operation without intermediate adjustment of the pH value thereof. It is enough, however, to adjust the initial pH value of solution, if necessary, to a desired pH value by the aid of said alkali metal hydroxides and/or carbonates thereof or the corresponding ammonium compounds.

In the practice of the present invention, it is necessary for the coating solution to contain at least about 0.5 percent by weight of phosphate ions in order to provide phosphate coatings with satisfactory coating properties. It is usually desired for there to be the upper limit of phosphate ion at about 10 percent by weight with respect to the coating solution. Although phosphate coating solutions containing higher concentrations of phosphate ion are used, it may be disadvantageous from the economical point of view because the higher the phosphate ion concentration, the more the phosphate ions are consumed. It is also necessary for the phosphate ions to be present in a molar weight ratio thereof to nitrate ion of from about 1:0.7 to 1:1.3. When this ratio exceeds the upper limit, it is difficult that the pH value of solution be maintained within said desired scope ranging from about pH 3.3 to pH 3.8, and the pH values of the coating solution tend to drop below pH 3.1. Such low pH values may cause an increase in the decomposition of nitrites and comsumption thereof and in the formation of nitrogen oxides and sludges in a larger amount, for example, by about two to four times, compared to where the zinc phosphate coating solution having a pH value within said desired range. Where a zinc phosphate coating solution having a pH value lower than said lower limit is used, sludges formed tend to adhere to or stick to equipment in which the coating is effected, thereby making it difficult to remove the sludges from the equipment. If alkali metal and/or ammonium ions which are added to maintain the pH value of the coating solution may increase to an extent greater than needed for the adjustment of pH values of the coating solution, this may bring about a decrease in an amount of zinc ions of lower than 0.03 percent by weight. In this case, the tendency to form rusts on the phosphate coated surfaces of a metal object is enhanced. Where the molar weight ratio of phosphate to nitrate ions drops below said lower limit, the pH values of solution may exceed pH 3.8. The pH value higher than pH 3.8 may provide no good phosphating coating and cause temper color and/or rust on a metal object. Thus, in this case, no satisfactory phosphating coatings are expected to be formed, although desired results may be obtained with respect to amounts of the decomposition and consumption of nitrites and the formation of nitrogen oxides and sludges which are to be easily handled.

In the practice of the present invention, it is desired for the zinc phosphate coating solution of the present invention to contain at least about 0.03 percent by weight of zinc ions, based on the total weight of the coating solution. The zinc ions should also be present in the molar weight ratio thereof to phosphate ion in a value not exceeding about 0.116:1. If the zinc ion to phosphate ion ratio exceeds said upper limit, it is difficult to maintain the zinc ions at a value satisfying said limit and the excess zinc ions precipitate out as sludges.

If desired, nickel ions may be added in an amount of at least 0.01 percent by weight and in a molar weight ratio thereof to zinc ion of lower than about 1.89:1. If the nickel ions are present in amounts beyond said limit, the effects which are expected to be obtained by the addition thereof may not be achieved and rather a tendency of decline on its expected effects may be recognized. The concentration of nitrite ions is preferably from about 0.002 to 0.05 percent by weight with respect to the coating solution. Where the solution contains less than the lower limit of the nitrite ions, no good phosphate coating is expected to be formed and the formation of rusts may result. Where the solution contains more than the upper limit thereof, a tendency to facilitate the self-decomposition of the nitrites and the formation of nitrogen oxides and sludges is increased, coupled with deterioration in coating properties which thus tend to bring about a temper color and impair the phosphating.

The zinc phosphate coating solution according to the present invention may be particularly applicable to an apparatus of the type designed to drain off little or no coating solution out of the phosphate coating system as that disclosed and claimed in U.S. patent application Ser. No. 318,612 to Morino et al. (which will be issued as U.S. Pat. No. 3,906,895 on Sept. 23, 1975). It is, however, to be understood that the zinc phosphate coating solution of the present invention may be applicable to any other conventional apparatus. Although the details of this apparatus are described in the specification of this patent application, the portion of the zinc phosphate coating system in the apparatus is described again hereinbelow with reference to the accompanying drawing, in which:

The sole FIGURE is a schematic plan view of an illustration of the phosphating and subsequent water rinse stations of the apparatus applicable preferably to the present invention.

Referring now in detail to the drawing and as may be best seen in the FIGURE, an apparatus is of the type in which a phosphate coating station is at station A; a first water rinse station is at station B; and a second water rinse station is at station C. A metal object to be treated is generally pre-treated at a processing arrangement comprising degreasing and water rinse station or stations and the transferred to the phosphating system comprising said construction. The phosphate-coated metal object, after being fully rinsed with water, may then be conventionally dried for further processing. Those stations and the stations for the phosphating system as well as the subsequent water rinsing may be arranged in a treating chamber or tunnel 1 through which the metal object is treated during the passage through the treating chamber while being suspended from a plurality of work racks or hangers 2 provided in an endless horizontal conveyor 3 extending along the top and length of the treating chamber.

A metal object 4 which had previously been treated at the degreasing station and rinsed with water at the subsequent water rinse station or stations is then advanced to the phosphate coating station at A. The phosphating station comprises a tank 10 and a spray chamber 11, said tank incorporating a pump 12 therein which can pump solution from the tank up through a supply line 13 to a plurality of spray headers, indicated generally by numeral 14, having a plurality of nozzles (not shown) so as to discharge the zinc phosphate coating solution against the surfaces of the metal object in all possible directions.

The tank 10 is provided with a pair of liquid level detectors comprising a maximum liquid level detector 15*a* and a minimum liquid level detector 15*b* for detecting the level of solution present in the tank 10. The maximum liquid level detector which is disposed above the minimum liquid level detector is capable of detecting the solution level when it exceeds a desired predetermined maximum, and the minimum liquid level detector is designed so as to respond to the solution in the tank when it drops below a desired predetermined minimum. When the solution level in the tank goes outside said predetermined levels, the involved liquid level detector 15*a* or 15*b* operates to transmit a signal to a liquid level control 16. The liquid level control which is connected by a circuit 17 to the liquid level detectors is designed such that it can control the amount of solution in the tank at a suitable level in response to the signal transmitted by either of the liquid level detectors 15*a* or 15*b* by adjusting the supply of fresh water and/or a water rinse solution from water rinse station at B and, at the same time, a water rinse solution to the station at B from station C. When the solution level exceeds said predetermined maximum, the control 16 is operated so as to stop supplying fresh water and/or the water rinse solution from the tank at water rinse station at B to the tank to maintain the solution level below the predetermined maximum therein. Where the solution level drops below said predetermined minimum, the minimum lequid level detector 15*b* transmits the signal to the control 16 so as to supply fresh water and the water rinse solution from the subsequent tank.

A supply line 18*a* is provided in the tank 10 for supplying the overflow of water rinse solution from the tank at station B and designed to operate by means of a solenoid valve 19 provided in the supply line, which is actuated in response to the signal transmitted through a circuit 20 by the liquid level control 16. The supply of the rinse solution from the tank at B to the tank 10 may also be effected by spraying the solution against the metal surface in the treating chamber and draining the sprayed rinse solution into the tank 10. The spraying of the water rinse solution can be controlled in substantially the same manner as with the overflow of the rinse solution from the tank at B to the tank 10. The supply of the water rinse solution by spraying may be made in combination with the overflow of the rinse solution by means of the supply line 18*a*.

Another supply line 21 is provided in the tank 10 for supplying fresh water from a suitable source, and the supply thereof is effected as necessary. The supply line is provided with a solenoid valve 22 so as to control the supply of the fresh water, said solenoid valve being designed so as to be actuated through a circuit 20 by the liquid level control 16.

The tank 10 is also provided with a discharge line 23 for discharging the solution therefrom by means of a valve 24. The discharge is effected as necessary when undesirable materials are accumulated in the tank in an undesirably high concentration and to such an extent that the phosphating is impaired.

In the tank 10 is a heating device 25 for heating the solution.

Water is a vaporized form resulting from the spraying of the solution in the spray chamber 11 is evacuated by means of an evacuating means 30 in the phosphating station at A, for example, in the spray chamber 11. The evacuating means may be composed of a fan 31, a vapor-liquid separator 32 for separating splashes or drops of the solution from the vaporized water, and a condenser 33 for condensing the vaporized water. The evacuation of the vaporized water is effected such that the water corresponds in amounts substantially to the amounts of the water supplied as the supply of the rinse solution from the tank at station B, thereby controlling the amount and concentration of the coating solution present in the tank at a substantially constant level.

The metal object 4 is then transferred to a next step at first water rinse station B. The first rinse station at B is composed of a tank 50 and a spray chamber 51, said tank incorporating a pump 52 therein which can pump solution from the tank 50 up through a supply line 53 to a plurality of spray headers 54 which are provided with a plurality of nozzles (not shown) located so as to discharge water against the metal object in the spray chamber 51 in all possible directions. The overflow of the water rinse solution from the tank 50 is supplied to the tank 10 through a discharge line 18*b*. A solenoid valve 19 is provided in the discharge line and actuated through a circuit 58 from the liquid level control 16, thereby adjusting the overflow of the rinse solution from the tank. The rinse solution may also be supplied to the tank 10 by spraying the rinse solution against the metal object and draining it thereinto. The spraying of the rinse solution may be made in combination with the overflowing of the rinse solution. In the tank 50 is a supply line 59*a* through which the overflow of the rinse solution is supplied thereto from a tank at station C.

The second water rinse station C has substantially the same structure as the first water rinse station B, comprising a tank 60 and a spray chamber 61, said tank being connected by a pump 62 through a supply line 63 to a plurality of spray headers 64 having a plurality of nozzles (not shown) for discharging the water rinse solution against the surfaces of the metal object so as to rinse the metal surfaces with the water rinse solution. In the spray chamber 61 is provided another set of spray headers 65 having a plurality of nozzles (not shown) which are connected by a supply line 66 to a suitable source of fresh water, thereby fully rinsing with water the surfaces of the metal object advancing through the treating chamber. The supply line 66 is suitably valved by means of a valve 67. In the tank 60 is provided a supply line 68 through which fresh water is supplied thereto from a suitable source. The supply line 68 is provided with a valve 69 and diverted before the valve 69 through a branch line 70*a* which is connected by a solenoid valve 71 to a branch line 70*b* which in turn is combined again with the supply line 68 after the valve 69. The solenoid valve 71 is actuated through a circuit 20 by the liquid level control 16, thereby controlling an amount of fresh water to be supplied to the tank 60. A discharge line 59*b* is provided in the tank 60 so as to have the excess of water rinse solution overflow to the tank 50 at station B. The overflow is controlled by a solenoid value 55 which is actuated through the circuit 58 by the control 16. The water rinse solution in the tank at station C may also be supplied to the tank 50 by spraying the rinse solution against the metal surfaces and draining the sprayed rinse solution into the tank at B. The supply of the rinse solution by spraying may be made in combination with the overflow thereof and can be controlled in substantially the same manner as with the overflow thereof.

The metal object thus rinsed may then be advanced to a drying station where the metal object is dried in conventional manner for further processing.

The following Examples, serve to illustrate the present invention without, however, limiting the same thereto.

EXAMPLE 1

With a six-station apparatus having the phosphating system as seen in the FIGURE, a cold rolled steel plate was subjected to zinc phosphate coating. The steel plate was first sprayed with a solution containing a 1 percent of a weakly alkaline degreasing agent "Ridoline No. 1006N-1" (trade mark of Nippon Paint Co., Ltd.) having a temperature of 50° to 60° C. for 2 minutes and then transferred to water rinse stations. After being rinsed with water at room temperature twice, each for 1 minute, the steel plate was then subjected to zinc phosphate coating at phosphating station in which said plate sprayed with a zinc phosphate coating solution having a pH value of 3.4 and the following composition at 50° to 55° C. for 2 minutes.

| Composition | Percent by Weight |
|---|---|
| $PO_4^{3-}$ | 1.10 |
| $NO_3^-$ | 0.70 |
| $Zn^{2+}$ | 0.05 |
| $Na^+$ | 0.45 |
| $NO_2^-$ | 0.01 - 0.015 |

This solution had the phosphate ion to nitrate ion ratio of 1:0.967. A sodium nitrite aqueous solution and an aqueous concentrate containing ions such as phosphate, nitrate and zinc ions necessary to maintain the desired composition of said zinc phosphate coating solution was replenished to the coating bath. The steel plate thus phosphate-coated was then rinsed twice with water at room temperature each for 1 minute and dried.

It was found that the zinc phosphate coating solution was maintained within the scope ranging pH 3.4 plus minus 0.1.

The phosphate coating formed on the surface of the steel plate was found to be a good, uniform and fine coating layer. During said phosphate coating process, the amount of sodium nitrite consumed was 1.5 grams per square meter of the treating steel plate area. In the bottom of the tank in which the phosphate coating was effected, 20 grams per square meter of sludges (water content: 90 percent) were sedimented, and these sludges did not adhere to the tank and were in a form that was removed with ease.

It is to be noted that in this example, nitrate and sodium ions present in the solution showed little tendency to increase, and the phosphating solution used for 3 months in which 800 square meters of the steel plate per day were employed still maintained a good phosphating capacity. The steel plate thus treated had still a good phosphate coating thereon.

EXAMPLE 2

Example 1 was repeated using the procedures, apparatus and treating conditions employed therein except for using a zinc phosphate coating solution having a pH value of 3.6 and the following composition:

| Composition | Percent by Weight |
|---|---|
| $PO_4^{3-}$ | 1.17 |
| $NO_3^-$ | 0.70 |
| $Zn^{2+}$ | 0.048 |
| $Ni^{2+}$ | 0.026 |
| $Na^+$ | 0.48 |
| $NO_2^-$ | 0.01 - 0.015 |

This solution had the phosphate ion to nitrate ion ratio of 1:0.91 and the zinc ion to nickel ion ratio of 1:0.60. During the phosphate coating a concentrate was supplied in order to maintain the necessary composition of the solution.

The pH values of the zinc solution were found to be maintained within the scope ranging 3.6 plus minus 0.1.

The steel plate thus treated was found to possess a better over-all phosphate coating layer than that obtained in Example 1. The amount of the sodium nitrite consumed was 1.2 grams per square meter of the treating area of steel plate. Sludges were formed in an amount of 15 grams per square meter (water content: 90 percent), and they did not stick to the apparatus and they are easily removed therefrom.

It was found that nitrate and sodium ions present in the phosphating tank showed little tendency to increase, and the phosphate coating solution used for 3 months in which 800 square meters of the steel plate per day were employed still maintained a good phosphating ability. The steel plate thus treated still had a good phosphate coating thereon.

The following Comparative Examples are given to describe conventional zinc phosphate coatings.

COMPARATIVE EXAMPLE 1

With an apparatus having a conventional six-station construction, the procedure of Example 1 was repeated using a conventional zinc phosphate coating solution having a pH value of 3.0 and the following composition:

| Composition | Percent by Weight |
|---|---|
| $PO_4^{3-}$ | 1.50 |
| $NO_3^-$ | 0.60 |
| $Zn^{2+}$ | 0.16 |
| $Na^+$ | 0.43 |
| $NO_2^-$ | 0.013 - 0.016 |

The phosphate ion to nitrate ion molar weight ratio of this solution was 1:0.61.

Although the steel plate thus treated possessed a good phosphate coating film thereon, the amount of sodium nitrite consumed was 3.0 grams per square meter; the amount of sludges formed was 60 grams per square meter (water content: 90 percent); and such sludges tended to be sticky and difficult to remove.

COMPARATIVE EXAMPLE 2

The procedure of Example 1 was repeated using the zinc phosphate coating solution employed in Comparative Example 1.

This procedure the results that phosphate coating films formed on the cold rolled steel plates become poor in two weeks because of a remarkable increase in sodium and nitrate ions in the coating solution due to the replenishment of a large amount of sodium nitrite therein. The phosphate steel plates also formed rusts and/or caused a temper color.

It was found that the pH value of this solution was raised to higher than pH 3.9.

The following Example and Comparative Example are given to show the properties of sludges formed.

EXAMPLE 3

The zinc phosphate coating solution employed in Example 1 was employed in the same manner as in Example 1 for phosphate-coating steel plates. Sludges sedimented in the bottom of the tank were determined with respect to zinc and iron contents as dry percent solids and the properties of the sludges formed.

The sludges were found to contain from about 15 to 20 percent by weight of zinc and from about 5 to 10 percent by weight of iron, and they were not sticky and easy to remove.

COMPARATIVE EXAMPLE 3

With the procedure of Example 1 and the conventional zinc phosphate coating solution and the apparatus employed in Comparative Example 1, steel plates were subjected to phosphate coating.

Sludges formed were found to contain from about 5 to 10 percent of zinc and from about 15 to 20 percent by weight of iron, and they were sticky and difficult to remove.

From both Example 3 and Comparative Example 3, it is found that the zinc phosphate coating solution of the present invention dissolves iron from the steel plates treated in a less amount than the conventional solution used and form sludges which are to be handled with ease as compared to those formed by the use of the conventional one.

The following is given to show the influence of the pH values of the solution on the self-decomposition of sodium nitrite and the concentration of nitrogen oxides.

The zinc phosphate coating solution of the present invention was employed at varying pH values and a temperature of 50° to 55° C. The phosphate coating solution was then determined with respect to the amount of sodium nitrite consumed (expressed in grams per square meter of the treating area) and the concentration of nitrogen oxides (expressed in parts per million). The results are set out in the following table.

| | pH Values of Treating Solutions | | | | |
|---|---|---|---|---|---|
| | 2.8 | 3.0 | 3.2 | 3.4 | 3.5 |
| Sodium Nitrite Consumed | 4.0 | 3.0 | 1.8 | 1.5 | 1.2 |
| Nitrogen Oxides | 3–5 | 2–3 | 1–2 | less than 1 | less than 1 |

From the previous results, it has been found that, by maintaining the coating solution within the scopes of the present invention, the amount of nitrites used as accelerators, the replenishment of the aqueous nitrite solution, and the formation of nitrogen oxides and sludges can be reduced. The sludges formed are also easy to handle. When the zinc phosphate coating solution of the present invention is employed for an apparatus in which little or no zinc phosphate coating solution is discharged out of the treating system, it is possible to keep the phosphating capacity of the coating solution substantially longer than when conventional zinc phosphate coating solutions are employed.

What we claim is:

1. In a continuous process for coating a zinc phosphate film on the surface of a metal article by spraying a zinc phosphate coating solution consisting essentially of nitrate ions, phosphate ions and zinc ions, onto the surface of the metal article, which metal article is one in a line of metal articles suspended and moving continuously or intermittently, at a station having a receptacle provided beneath the metal article, collecting the sprayed zinc phosphate coating solution in the receptable and circulating the collected zinc phosphate coating solution for spraying, the improvement wherein the zinc phosphate coating solution is controlled continuously throughout the coating process such that:

1. the phosphate ion concentration in the solution is at least 0.5% by weight;
2. nitrate ions are present in an amount such that the molar ratio of the phosphate ions to the nitrate ions in the solution is about 1:0.7 to 1:1.3;
3. the zinc ion concentration in the solution is at least 0.03% by weight;
4. the molar ratio of the zinc ions to the phosphate ions in the solution is less than 0.116:1; and
5. the pH of the solution is from 3.3 to 3.8.

2. The improvement according to claim 1, wherein nitrite, alkali metal and/or ammonium ions are present in the solution.

3. The improvement according to claim 2 wherein sodium, potassium or ammonium nitrite is employed as a source for the nitrite ions.

4. The improvement according to claim 2, wherein sodium or potassium nitrite, sodium or potassium hydroxide or sodium or potassium carbonate is employed as a source for the alkali metal ions.

5. The improvement according to claim 2, wherein ammonium nitrite, hydroxide or carbonate is used as a source for the ammonium ions.

6. The improvement according to claim 1, wherein phosphoric acids are employed as sources for the phosphate ions.

7. The improvement according to claim 1, wherein nitric acid is used as a source for the nitrate ions.

8. The improvement according to 1, wherein zinc flower, zinc carbonate or zinc nitrate is used as a source for the zinc ions.

9. The improvement according to claim 1, wherein the control of the zinc phosphate coating solution is carried out by adjusting the solution in the receptacle to maintain the concentration of components as recited in claim 1.

10. The improvement according to claim 1, wherein the nickel ions are also present in the phosphate coating composition and controlled so as to be present throughout the coating operation in an amount of at least 0.01 percent by weight based on the total weight of the solution and in a molar ratio thereof to the zinc ions of from 0.89:1 to 0.014:1.

11. The improvement according to claim 10, wherein nickel carbonate or nitrate is employed as a source for the nickel ions.

12. The improvement according to claim 1, wherein the phosphate ions are controlled throughout the coating operation so as to be present in an amount of from 0.5 to 10 percent by weight of the solution.

13. The improvement according to claim 1, wherein nitrite, alkali metal and/or ammonium ions are present in the solution.

14. The improvement according to claim 13, wherein the nitrite ions are present in a concentration of from about 0.002 to 0.05 percent by weight with respect to the weight of the coating solution.

* * * * *